US005228496A

United States Patent [19]

Nagai et al.

[11] Patent Number: 5,228,496

[45] Date of Patent: Jul. 20, 1993

[54] CAST STARTING METHOD IN HORIZONTAL CONTINUOUS CASTING

[75] Inventors: Yoshitaka Nagai; Makoto Arase; Norio Ohatake, all of Toyama, Japan

[73] Assignee: Yoshida Kogyo K. K., Tokyo, Japan

[21] Appl. No.: 877,387

[22] Filed: Apr. 29, 1992

Related U.S. Application Data

[63] Continuation of Ser. No. 521,405, May 10, 1990, abandoned.

[30] Foreign Application Priority Data

May 11, 1989 [JP] Japan ..... 1-116022

[51] Int. Cl.[5] ..... B22D 11/00

[52] U.S. Cl. ..... 164/472; 164/483; 164/440; 164/490

[58] Field of Search ..... 164/490, 440, 483, 472

[56] References Cited

U.S. PATENT DOCUMENTS

| | | | |
|---|---|---|---|
| 944,370 | 12/1909 | Monnot | 164/440 |
| 3,076,241 | 2/1963 | Simonson et al. | 164/440 |
| 3,344,846 | 10/1967 | Rossing | 164/440 |
| 3,455,369 | 7/1969 | Craig | 164/440 |
| 4,335,779 | 6/1982 | Morianz | 164/440 |

FOREIGN PATENT DOCUMENTS

| | | | |
|---|---|---|---|
| 761483 | 7/1971 | Belgium | 164/440 |
| 61-154736 | 7/1986 | Japan | 164/440 |
| 933199 | 6/1982 | U.S.S.R. | 164/440 |

*Primary Examiner*—Kuang Y. Lin

*Attorney, Agent, or Firm*—Hill, Steadman & Simpson

[57] ABSTRACT

A cast starting method in horizontal continuous casting, including the steps of locating an orifice plate having an orifice between a molten metal outlet of a tundish and a mold, the orifice plate being formed on its front side with a recess expanded in a range surrounding an outlet of the orifice, locating a starting block in the mold to let a rear end surface of the starting block contact a front surface of the orifice plate to define a closed space by the recess, locating a starting pin in the closed space at a position not aligned to the outlet of the orifice, letting a molten metal flow from the tundish through the orifice into the closed space, and drawing the starting block with the molten metal after solidified out of the mold.

1 Claim, 2 Drawing Sheets

CAST STARTING METHOD IN HORIZONTAL CONTINUOUS CASTING

This is a continuation of application Ser. No. 521,405, filed May 10, 1990, now abandoned.

BACKGROUND OF THE INVENTION

1. Field of the Invention

The present invention relates to a cast starting method in horizontal continuous casting which can carry out a cast starting operation stably and reliably.

2. Description of Prior Art

FIG. 4 shows a horizontal continuous casting device in the prior art. The horizontal continuous casting device includes an orifice plate 2 and a mold 3 provided on a front side of a tundish 1. In carrying out a cast starting operation by using such a device, a closed space is defined by an inner circumferential surface of the mold 3, a front surface of the orifice plate 2 and a rear end surface of a starting block 4, and a starting pin 5 is positioned in the closed space. Then, a molten metal 6 is allowed to flow from the tundish 1 through the orifice plate 2 into the closed space. After the molten metal 6 is solidified to some extent, the starting block 4 is drawn out of the mold 3.

In the conventional method as mentioned above, as a part of the closed space is formed by the inner circumferential surface of the mold 3, solidification of the molten metal 6 induced into the closed space proceeds early near the inner circumferential surface of the mold 3. Accordingly, when the starting block 4 is drawn out of the mold 3, the molten metal 6 solidified near the inner circumferential surface of the mold 3 sticks to the mold 3, and the solidified molten metal at this portion cannot follow the drawing movement of the starting block 4. As a result, there is a possibility that breakout will occur. Thus, it is very difficult to determine a drawing timing of the starting block 4.

SUMMARY OF THE INVENTION

The present invention has improved this respect, and it is an object of the present invention to make the drawing of the starting block easy without the possibility of the breakout.

According to the present invention, there is provided a cast starting method in horizontal continuous casting, comprising the steps of locating an orifice plate having an orifice between a molten metal outlet of a tundish and a mold, the orifice plate being formed on its front side with a recess expanded in a range surrounding an outlet of the orifice, locating a starting block in the mold to let a rear end surface of the starting block contact a front surface of the orifice plate to define a closed space by the recess, locating a starting pin in the closed space at a position not aligned to the outlet of the orifice, letting a molten metal flow from the tundish through the orifice into the closed space, and drawing the starting block with the molten metal after solidified out of the mold.

It is preferable that the orifice plate can be replaced because a length of the orifice plate should be changed according to different kinds of alloy to be cast. Further, a plurality of orifices are preferably formed through the orifice plate, and they are arranged at positions not aligned to the starting pin. Further, a lubricating oil is preferably supplied to an outer circumference of the recess of the orifice plate.

According to the present invention, as the solidification of the molten metal starts at the portion contacting the starting block and the starting pin, and no portion of the solidified molten metal contacting the mold is present, there is no possibility that the solidified molten metal will stick to the mold, and will not be able to follow the movement of the starting block. Accordingly, the breakout does not occur to ensure that the cast starting operation can be carried out stably and reliably.

Other objects and features of the invention will be more fully understood from the following detailed description and appended claims when taken with the accompanying drawings.

DETAILED DESCRIPTION OF THE PREFERRED EMBODIMENT

The preferred embodiment will now be described with reference to the drawings.

Figure 1:
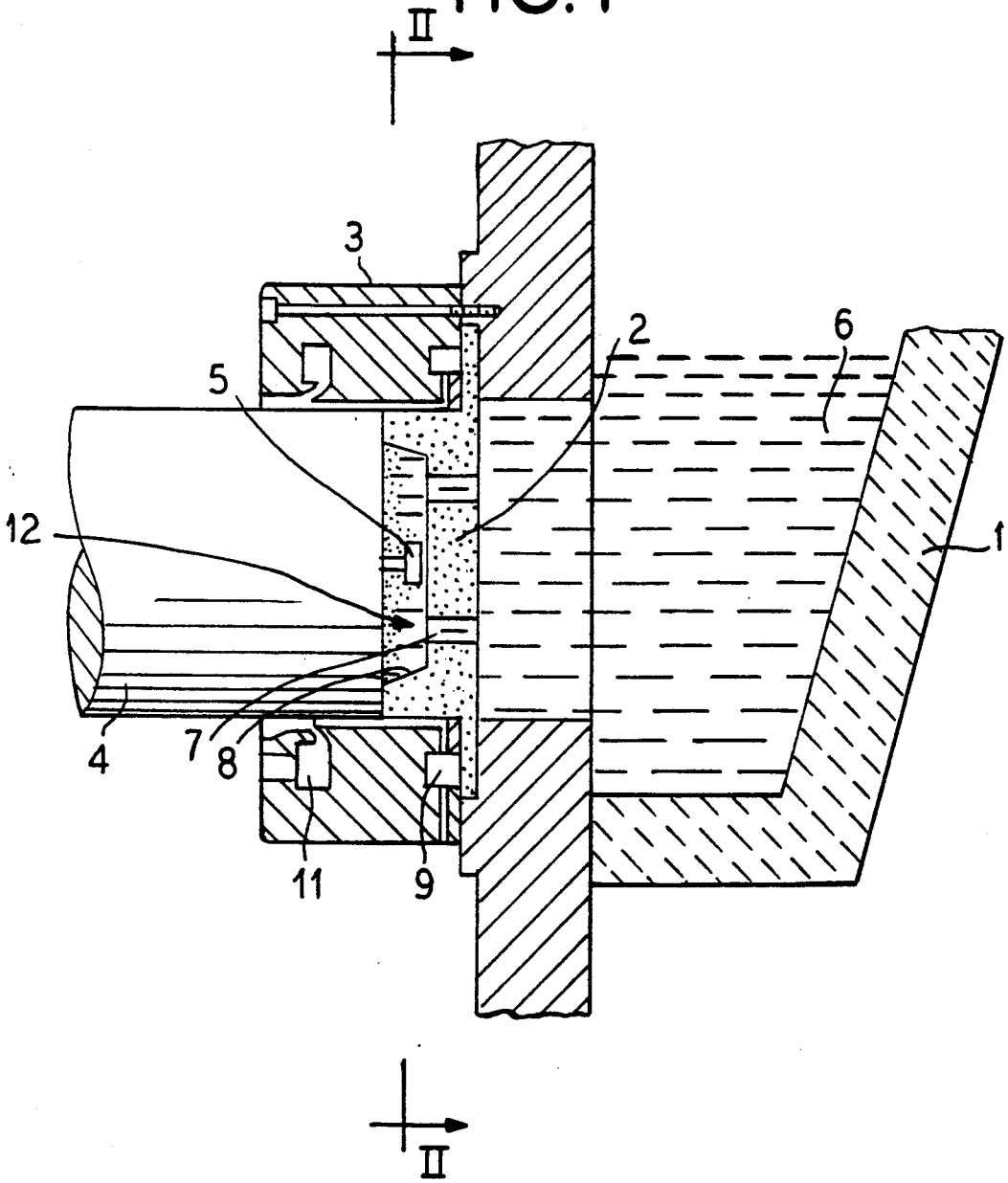
FIG. 1 is a sectional view of the device suitable for embodying the present invention.
Figure 2:
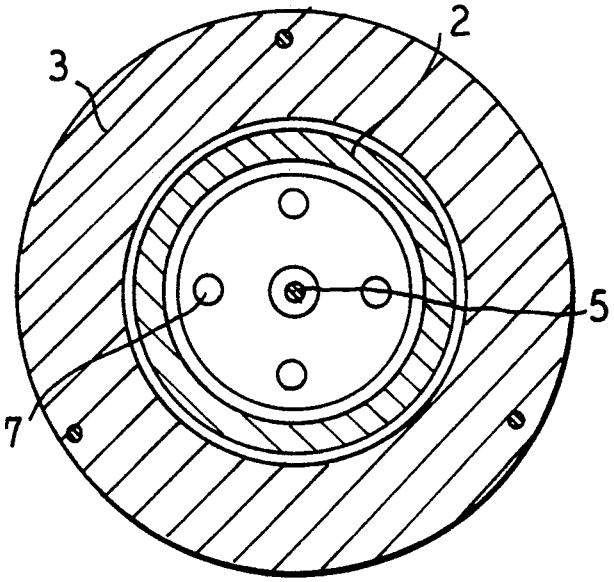
FIG. 2 is a cross section taken along the line II—II in FIG. 1.
Figure 3:
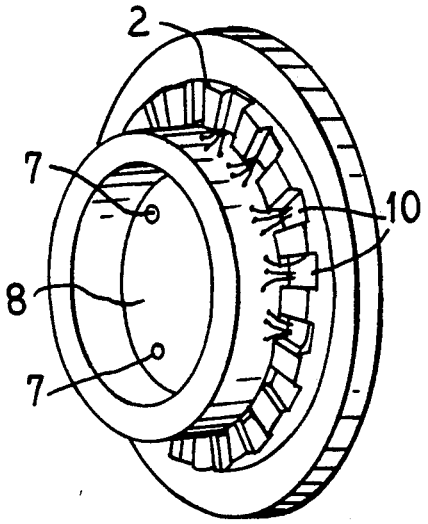
FIG. 3 is a perspective view of the orifice plate.
Figure 4:
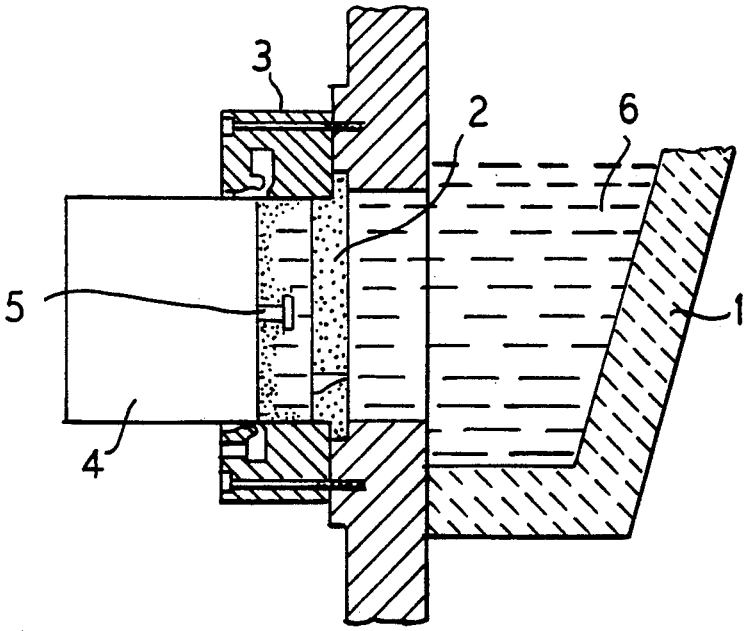
FIG. 4 (PRIOR ART)
FIG. 4 is a sectional view of the prior art device.

FIGS. 1 to 3 show a device suitable for embodying the present invention, in which FIG. 1 is a vertical sectional view of the device; FIG. 2 is a cross section taken along the line II—II in FIG. 1; and FIG. 3 is a perspective view of an orifice plate. In FIGS. 1 to 3, the same or corresponding parts as those shown in FIG. 4 are designated by the same reference numerals. An orifice plate 2 is provided with a plurality of (four in this embodiment) orifices 7, and a recess 8 is formed on a front surface of the orifice plate 2. Reference numeral 9 designates a lubricating oil passage. A lubricating oil flowing in the lubricating oil passage 9 is supplied through a plurality of radial grooves 10 provided around the front surface of the orifice plate 2 to an annular space between an outer circumference of the orifice plate 2 at its front portion and an inner surface of a mold 3, thus lubricating outer circumferences of a starting block 4 and an ingot. Reference numeral 11 designates a cooling water passage for injecting a cooling water to the outer circumference of the ingot and thereby cooling the ingot.

In carrying out the cast starting operation, a rear end surface of the starting block 4 is brought into abutment against the front surface of the orifice plate 2 to define a closed space 12. At this time, a starting pin 5 is located at a position not aligned to outlets of the orifices 7. Then, a molten metal 6 is allowed to flow from a tundish 1 through the orifices 7 into the closed space 12. Solidification of the molten metal 6 starts at a portion contacting the starting block 4 and the starting pin 5, and early proceeds at this portion. The back side of the starting pin is parallel to the end surface of the starting block 4 as shown. A range of this portion is shown like a mist in the closed space 12 in FIG. 1, and no portion of the solidified molten metal contacting the mold is present. After a solidification time proceeds to some extent, the starting block 4 is drawn out of the mold 3 to start continuous casting.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A casting starting method in a horizontal continuous casting utilizing a tundish having a molten metal outlet and a mold for carrying out the casting, comprising the steps of:

preparing an orifice plate provided with an orifice means formed throughout its thickness direction;

locating the orifice plate between the molten metal outlet of the tundish and the mold so as to close the molten metal outlet and communicate the molten metal outlet of the tundish with an inside of the mold through the orifice means, said orifice plate being provided with a recessed portion on the side of the mold, which expands in a range outside an outlet of the orifice means, said orifice plate formed with a plurality of oil supplying grooves between an outer surface of the orifice plate and an inner surface of the mold so as to extend to an annular surface between an outer circumference of the orifice plate and the inner surface of the mold to thereby lubricate the mold by oil supplied from an oil supply formed to the orifice plate through the oil supplying grooves;

locating and inserting a starting block in the mold to let an inserted surface of the starting block contact an end surface of the orifice plate on the side of the mold to define a closed space between the inserted end surface of the starting block and the recessed portion of the orifice plate, said starting block being provided with a starting pin disposed at substantially a central portion of the inserted end surface of the starting block, said starting pin having an enlarged head portion and being positioned at a portion shifted from the outlet of the orifice means in an axial direction;

flowing a molten metal from said tundish through said orifice means into the closed space defined by the inserted end of the starting block and the recessed portion; and drawing said starting block with the molten metal in the closed space after it has solidified out of the mold.

* * * * *